United States Patent [19]

Wu

[11] 4,228,896

[45] Oct. 21, 1980

[54] PACKING DEVICE FOR DECORATIVE STRING SET

[76] Inventor: Jeng-Shyong Wu, No. 133 Tungshing Rd., Toufun, Maulii, Taiwan

[21] Appl. No.: 20,702

[22] Filed: Mar. 15, 1979

[51] Int. Cl.[3] ..... B65D 85/42

[52] U.S. Cl. ..... 206/420; 206/480; 206/482

[58] Field of Search ..... 206/419, 420, 421, 422, 206/477, 478, 479, 480, 481, 482, 483

[56] References Cited

U.S. PATENT DOCUMENTS

| | | | |
|---|---|---|---|
| 795,510 | 7/1905 | Hoff | 206/480 |
| 1,492,113 | 4/1924 | Welsh | 206/478 |
| 1,643,421 | 9/1927 | Rowan | 206/482 |
| 2,598,492 | 5/1952 | Boes | 206/482 |
| 3,246,745 | 4/1966 | Stoker, Jr. | 206/419 |
| 3,952,873 | 4/1976 | Pampuch et al. | 206/419 |
| 3,963,123 | 6/1976 | Beal | 206/477 |

*Primary Examiner*—Joseph Man-Fu Moy
*Attorney, Agent, or Firm*—McGlew and Tuttle

[57] ABSTRACT

A packing device comprising a protective panel, a base member and a fastener element made of insulative material for decorative light string sets of various sizes and different numbers of lights. The fastener elements having a plurality of claws, the number of which is identical to the number of bulbs to be held and the claws hold sockets of the bulbs firmly so that a packed decorative light string set is secured and held uniformly. The packing operation is therefore fast and simply.

11 Claims, 8 Drawing Figures

PACKING DEVICE FOR DECORATIVE STRING SET

FIELD AND BACKGROUND OF THE INVENTION

Traditionally decorative lights string sets are packed in a box comprising a plurality of folded bases and made of hard paper board or polyron. In the concave space formed by the folded bases, bulb sockets connected in the string set are installed. The packing device of such structure is large in voloume. There is also a waste of material. Furthermore, numbers of folded bases, i.e. numbers of concave spaces are fixed in forming, therefore it can not be adjusted and assembled optionally to comply with various bulb sockets, the packing operation is made very inconvenient.

SUMMARY OF THE INVENTION

It is a principal object of the present invention to provide a packing device for decorative light string sets comprising protective means, base means and fastener means combined so that means wherein the protective and the base means are of integral formation and the fastener means is engaged with the base means and easily separable therefrom.

Another object of the invention is to provide a packing device for a decorative light string set wherein the fastener means haves a plurality of claws for holding the lamp sockets of the string set, firmly.

A further object of the invention is to provide a packing device for a decorative light string set which is compact in volume and convenient in its loading and unloading.

A still further object of the invention is to provide a packing device for decorative string set which can be suitable for string sets consisting of any number of bulbs, and variable optionally for assembly operation in practical packing, therefore, different pattern of packed string set can be arranged thereof.

A still further object of the present invention is to provide a packing device which is simple in design, rugged in construction and economical to manufacture.

The various features of novelty which characterize the invention are pointed out with particularity in the claims annexed to and forming a part of this disclosure. For a better understanding of the invention, its operative advantages and specific objects attained by its uses, reference is made to the accompanying drawings and descriptive matter in which preferred embodiments of the invention are illustrated.

DESCRIPTION OF THE PREFERRED EMBODIMENT

Figure 1:
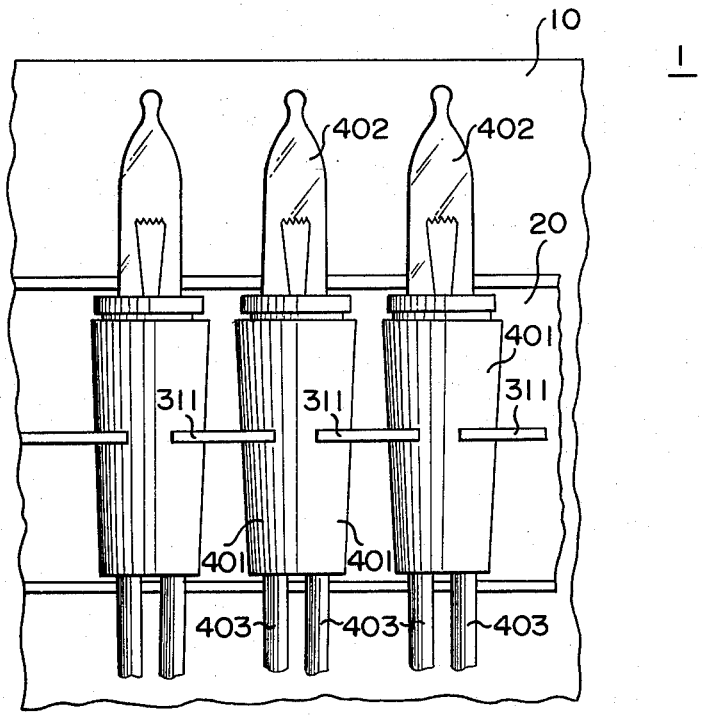
FIG. 1 is a top view of a decorative light string set which has been packed in the packing device according to the invention.
Figure 2:
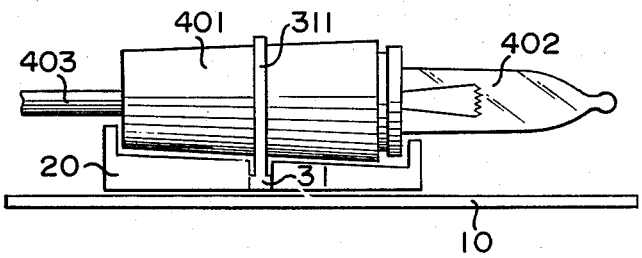
FIG. 2 is a side view of the device shown in FIG. 1.
Figure 3A:
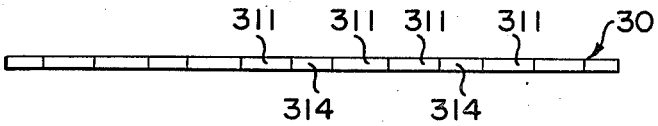
FIG. 3A is top view for a fastener means of the packing device according to the invention.
Figure 3B:
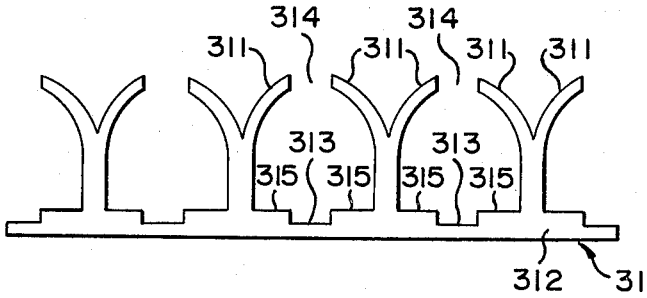
FIG. 3B is a front view of the device of FIG. 3A.
Figure 3C:
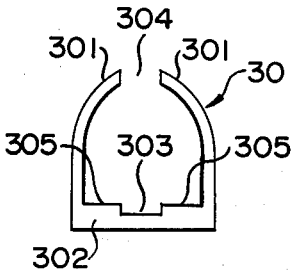
FIG. 3C is a plan view of a single fastener means of the packing device according to the invention.
Figure 4:
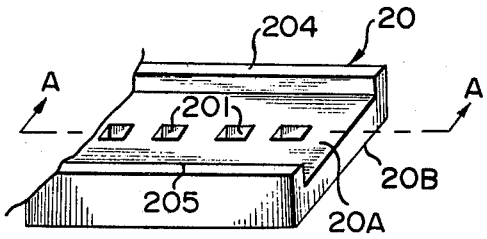
FIG. 4 is perspective view for a base means of the packing device according to the invention.
Figure 5:
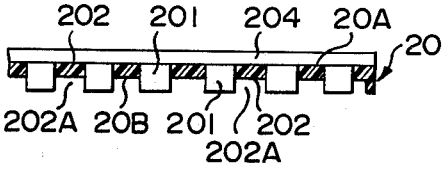
FIG. 5 is a sectional view taken along a line A—A in FIG. 4.
Figure 6:
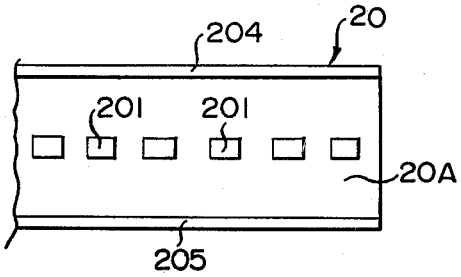
FIG. 6 is a top view of the device of FIG. 4.

As shown in the attached drawings, the packing device 1 according to the invention comprises protective means or card 10, base means 20, fastener means 30 and an external box (not shown). The protective means 10 is of paper board, plastic board or other board, which can also be integrally formed with the fastener means 30, or replaced by a base board of the external box. The protective means 10 is provided for preventing damage to a light set in an accident or careless handling during transportation and/or in application. The base means 20 as shown in FIGS. 4 to 6, is a body on which a plurality of openings 201—201 are provided and a front stand 204 and a rear stand 205 are formed respectively at the opposite sides of the base means 20. On bottom surface 20B of the base means 20 there are a plurality convex blocks 202—202 (as shown in FIG. 5) wherein a plurality of spaces 202A—202A are formed between every two consecutive convex blocks 202—202. These act as interengagement means between the base and the fastener means. Base means 20 is used for supporting and fixing bulb sockets of the string set and can be made of insulative material. An embodiment of the fastner means 30 of the packing device 1 according to the invention as shown in FIG. 3C is in a single form. The fastener means 30 haves two claw elements 301—301 and a seat 302 in an integral formation. The surface of the seat 302 can be flat or present a cavity 303. The shape of the cavity 303 should match the form of the convex block 202 of base means 20. Two flanges 305—305 are formed respectively at both sides of the cavity 303. Between the two claw elements 301—301 there is an opening 304 for loading and releasing of the bulb socket 401 of the string set. The size of such an opening, 304 depends on the specification of the lamp socket 401 and/or other practical requirements. As shown in FIGS. 3A and 3B, an another embodiment of the fastener means 31 of the packing device according to the invention is integrally formed by a plurality of single fastener means 30 as shown in FIG. 3C. The structure of the fastener means 31 is simliar to that of fastener means 30 as shown in FIG. **3*c*, in which 311—311 depict its claw elements, 312—312 are its seats, 313—313 are cavities, 314—314 are openings between every the two consecutive claw elements 311—311 and 315—315 are flanges beside the cavities 313—313**.

In packing the decorative light string set, firstly, the cavities 313—313 of the fastener means 31 are the engaged against convex blocks 202—202 on the bottom surface 20B of the base means 20, then, the fastener means 31 is fixed. Simultaneously, pass the claw elements 311—311 of the fastener means 31 are passed together and passed through the openings 201—201 of the base means 20. They then project outwardly so that the flanges 315—315 of the fastener means 31 are just inserted into the openings 201—201 of the base means 20. Then, the bulb sockets 401—401 of the string set shaped into and held by the claw elements 311—311 through the openings 314—314 formed by every two consecutive claw elements 311—311. The and the bulb sockets 401—401 are held close to the upper surface 20A of the base means 20 and restrained respectively by the front and rear stands 204, 205 of the base means 20. The bulb sockets 401—401 are thus tightly mounted.

The upper surface 20A and bottom surface 20B of the base means 20 also have another function. That is to act against the gravity of the bulb sockets 401—401 and to preventing the upward moving of the fastener means 31 respectively. Therefore, the fastener means 31 is engaged with the base means 20 tightly.

The decorative light string set is composed of a plurality of bulb sockets 401—401, bulbs 402—402 and connecting conductors 403—403. Since this is a traditional design, a detailed description is omitted thereof.

From the foregoing description, the advantages and features of the packing device for decorative light string sets according to the invention are apparent summarizing the features:

(1) The device is composed of three members which are made of insulative material and can be manufactured by mass production; the cost is thus reduced.

(2) The packed decorative string set is compact and the freight is thus reduced.

(3) Variations of the claw elements of the fastener means and numbers of base means allow it to be adaptable for a string set of different specification. The device is convenience in a packing process. For example, a string set having 35 bulbs, that is, there must be 35 bulb sockets, then, the said fastener means 31 can be of 35 positions for mounting them and made in integral formation, or of 5 positions but 7 pieces single fastener means can be assembled for holding 35 bulb sockets, and so on. The therefore, manner of assembly of the fastener means can be varied to adapt the number of the bulb sockets in the string set.

(4) Providing a facility for different patterns in packing of string sets in a packing box.

What I claim is:

1. A packing device for a decorative light string set having a plurality of sockets with bulbs therein comprising:

a base member carried on a protective card, said base member having a front and a rear raised stand formed respectively at opposite ends thereof and defining a recess for receiving the bulbs and sockets of the decorative light string set to be packed, with the front and the rear ends of each bulb and socket in alignment with said front and said rear raised stands, said base member having a plurality of through-openings in said recess, spaced along a direction transverse to a longitudinal axis of the bulbs and sockets when they are received in said recess;

a fastener member having a lengthwise seat and a number of spaced, upwardly-extending claw elements formed on and integrally with the seat, said fastener member fitted into a position in which said claw elements each extend up through a corresponding through-opening of said base member from a bottom side of said recess so that any two adjacent claw elements can grip, between them, one bulb and socket in said recess intermediately of said front and rear stands and hold the bulb and socket firmly against an upper surface of said base member; and an upper surface of said seat of said fastener member and a lower surface of said base member being provided with interengagement means so that said fastener member when in its fitted position, is firmly attached to said base member.

2. A device as defined in claim 1, wherein said interengagement means includes a cavity formed in the upper surface of said seat of said fastener member and a convex block formed in the lower surface of said base member, the cavity of said fastener member adapted to engage with said convex block; said seat including a flange around said cavity of said fastener member adapted to be inserted into said through-opening of said base member to assure the secure engagement of said fastener member and said base member.

3. A device as defined in claim 1, wherein said fastener member is divided into a number of individual units, each unit being formed integrally of two of said claw elements and one of said seat sections with a space defined between said two claw elements.

4. A device as defined in claim 1, wherein said two adjacent elements of said fastener member extend toward each other so that said claw elements are able to hold at least one half of a circumference of the bulb and socket.

5. A device as defined in claim 1, wherein said claw elements are of circular shape.

6. A device as defined in claim 1, wherein the upper surface of a portion of said base member between two adjacent through-openings has a flat shape in cross section for supporting the bulb and sockets in the decorative light string set.

7. A device as defined in claim 1, wherein both the upper surface of said seat or said fastener member and the lower surface of said base member are flat, and said interengagement means includes adhesive.

8. A device as defined in claim 1, wherein said claw elements are of a square shape.

9. A device as defined in claim 1, wherein said claw elements are of a curved shape.

10. A device as defined in claim 1, wherein the upper surface of a portion of said base member between two adjacent through-openings has an arch shape in cross section for supporting the bulb and sockets in the decorative light string set.

11. A device as defined in claim 1, wherein the upper surface of a portion of said base member between two adjacent through-openings has a square shape in cross section for supporting the bulb and sockets in the decorative light string set.

* * * * *